United States Patent [19]

Mihalinec

[11] Patent Number: 4,863,412

[45] Date of Patent: Sep. 5, 1989

[54] GLIDER TOY ASSEMBLY

[75] Inventor: Bozidar Mihalinec, Divizije, Yugoslavia

[73] Assignee: BPA Inc., Uniontown, Pa.

[21] Appl. No.: 221,344

[22] Filed: Jul. 19, 1988

[51] Int. Cl.[4] ..... A63H 27/00

[52] U.S. Cl. ..... 446/66; 446/62

[58] Field of Search ..... 446/62, 61, 63, 66

[56] References Cited

U.S. PATENT DOCUMENTS

| | | | |
|---|---|---|---|
| 2,221,012 | 11/1940 | Walker | 446/62 |
| 2,268,487 | 12/1941 | Jacobs | 446/62 |
| 3,653,151 | 4/1972 | Laurent | 446/66 |
| 4,357,777 | 11/1982 | Kulik | 446/62 |

*Primary Examiner*—Robert A. Hafer
*Assistant Examiner*—D. Neal Muir
*Attorney, Agent, or Firm*—Paul Bogdon

[57] ABSTRACT

A toy glider assembly is disclosed. The glider includes a fusilage, vertical stabilizer, and horizontal stabilizer. Wings are received in wing receiving members which are pivotably connected to a main wing support housing which in turn is pivotably connected to the fusilage. Pivoting the main wing support housing and the wing receiving members results in the wings being longitudinally aligned with the fusilage. A force imparting member is operative between the fusilage and the wing receiving members urging a force for emplacing the wings in their flight orientation with respect to the fusilage. A slignshot-like catapult serves to launch the glider assembly. In launching, the wings are held in longitudinal alignment with the fusilage and will open into flight orientation when the glider reaches its upper launch height. There is also provided an adjusting screw operative between the main wing support housing and fusilage for selectively adjusting the angle of attack of the wings whereby differing flight patterns may be realized.

3 Claims, 2 Drawing Sheets

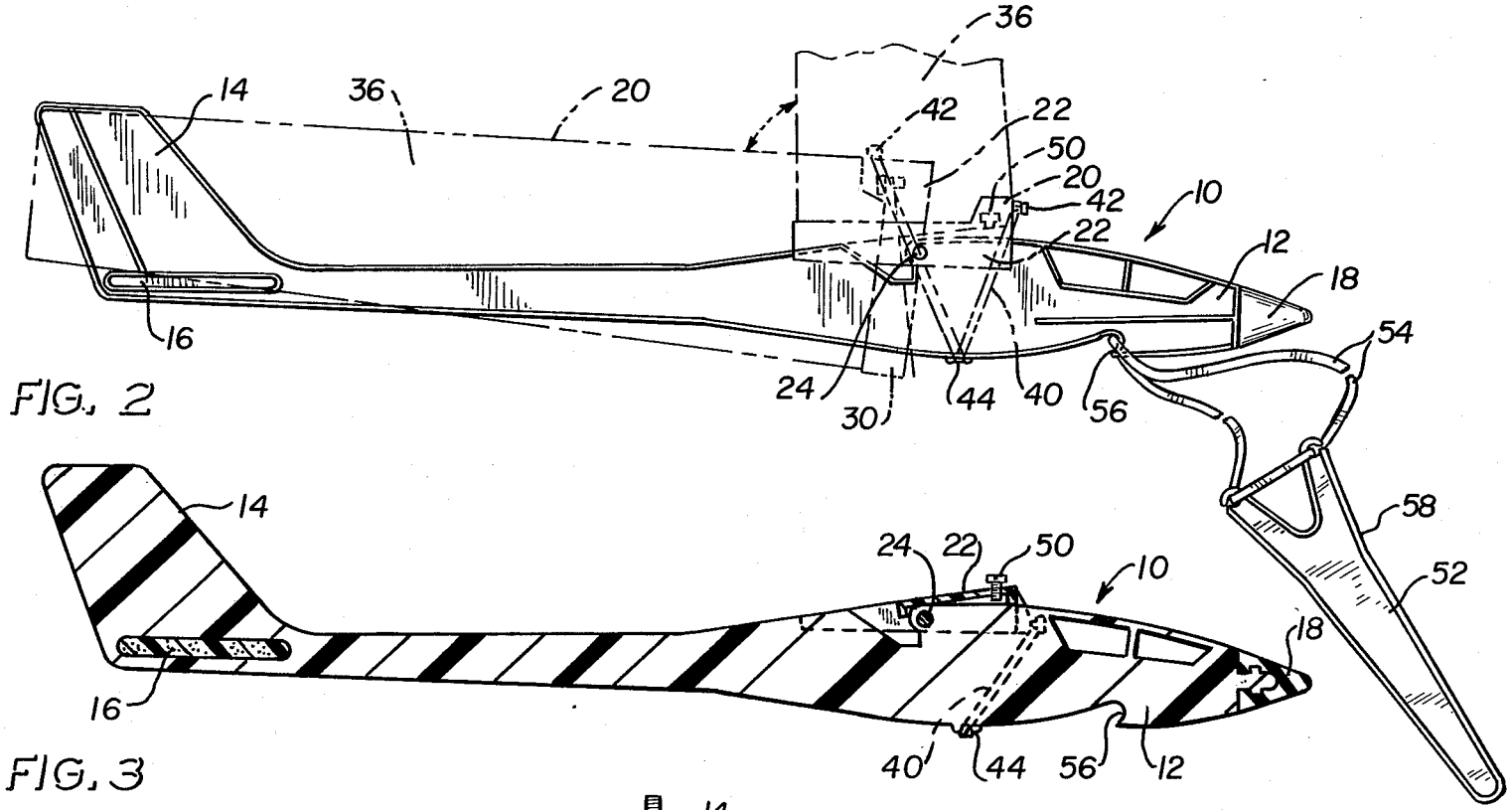
FIG. 2
FIG. 3
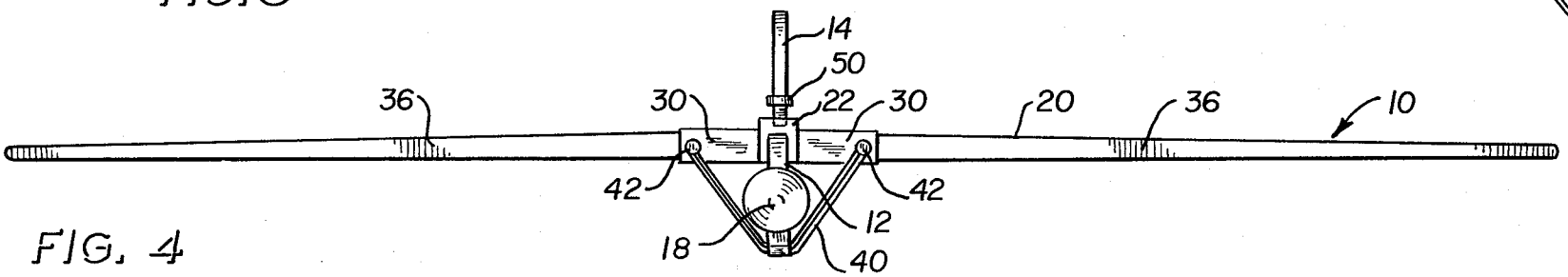
FIG. 4

GLIDER TOY ASSEMBLY

BACKGROUND OF THE INVENTION

This invention relates to a glider toy assembly which is hand held and simply launched by use of a slingshot-like catapult.

Various glider toys exist, some being launched by hand simply by throwing them while others are launched using a slingshot-like catapult. Most of the known glider toys are composed of wings fixed in their flight orientations with respect to their fusilages. Such assemblies are limited in the heights to which they may be launched and the flight patterns they may take.

My invention overcomes the limitations of the known glider toys by providing one which has wings that are pivotable with respect to the fusilage, allowing a higher launch height than heretofore attainable. Also, my invention provides wings which have selectively adjustable dihedral angles allowing different looping flight patterns.

SUMMARY OF THE INVENTION

This invention provides a toy glider assembly which preferably comprises: a fusilage having a nose section and a rear vertical stabilizer; a horizontal stabilizer; an elongated main wing support housing pivotably connected to the fusilage at an intermediate place thereof to rotate about an axis transverse to the longitudinal axis of the fusilage toward and away from the vertical stabilizer such that when the wing support housing is pivoted away from the vertical stabilizer it will substantially align with the fusilage and will abut an upper portion of the fusilage; a pair of oppositely disposed elongated wing receiving members each having their inner side pivotably connected along the side edge of the main wing support housing to rotate about an axis generally parallel to the axis of the main support housing; a pair of wings, one each receive at its inner end section by one of the wing receiving members; the fusilage, main wing support housing, wing receiving members, and wings being constructed and arranged with respect to each other such that when the main wing support housing is rotated toward the vertical stabilizer, and the wing receiving members are pivoted toward the main wing support housing, the wings will align longitudinally with and will abut the sides of the fusilage; and a resilient force imparting means operative between the fusilage and the wing receiving members for imparting a force on the wing receiving members to urge a pivoting force thereon to pivot the wing receiving members with respect to the main wing support housing and the main wing support housing with respect to the fusilage to emplace the wings in their flight orientation with respect to the fusilage whenever any externally applied force on the wings tending to pivot the wings into longitudinal alignment with the fusilage is removed. The glider toy is launched vertically with a slingshot-like catapult while holding the wings in alignment against the fusilage. When the glider reaches its ultimate height the wings are urged into flight orientation and the glider sails smoothly downwardly to the launching surface. An adjusting means may be provided between the main wing support housing and the fusilage for selectively changing the angle of attack of the wings, thereby resulting in differing looping flight patterns. The adjusting means may be a simple screw received in an opening through the main wing support housing. Turning the screw will shift the angular position the main wing support housing makes with the fusilage thereby changing the wings' angles of attack. The force imparting means for urging the wings into their flight orientation may simply be an elastic band held by the fusilage and connected with each wing receiving member.

Various other advantages, details, and modifications of the present invention will become apparent as the following description of a certain present preferred embodiment proceeds.

DESCRIPTION OF THE DRAWINGS

In the accompanying drawings I show a certain present preferred embodiment of my invention in which:

FIG. 2 is a side elevation view of my glider toy assembly showing in phantom outline the main wing support housing and a wing receiving member pivoted with a wing longitudinally aligned with the fusilage;

FIG. 3 is a view taken along the line 3—3 of FIG. 1; and

FIG. 4 is a front elevation view of my glider toy assembly showing the wings in flight orientation with respect to the fusilage.

DESCRIPTION OF A PREFERRED EMBODIMENT

Figure 1:
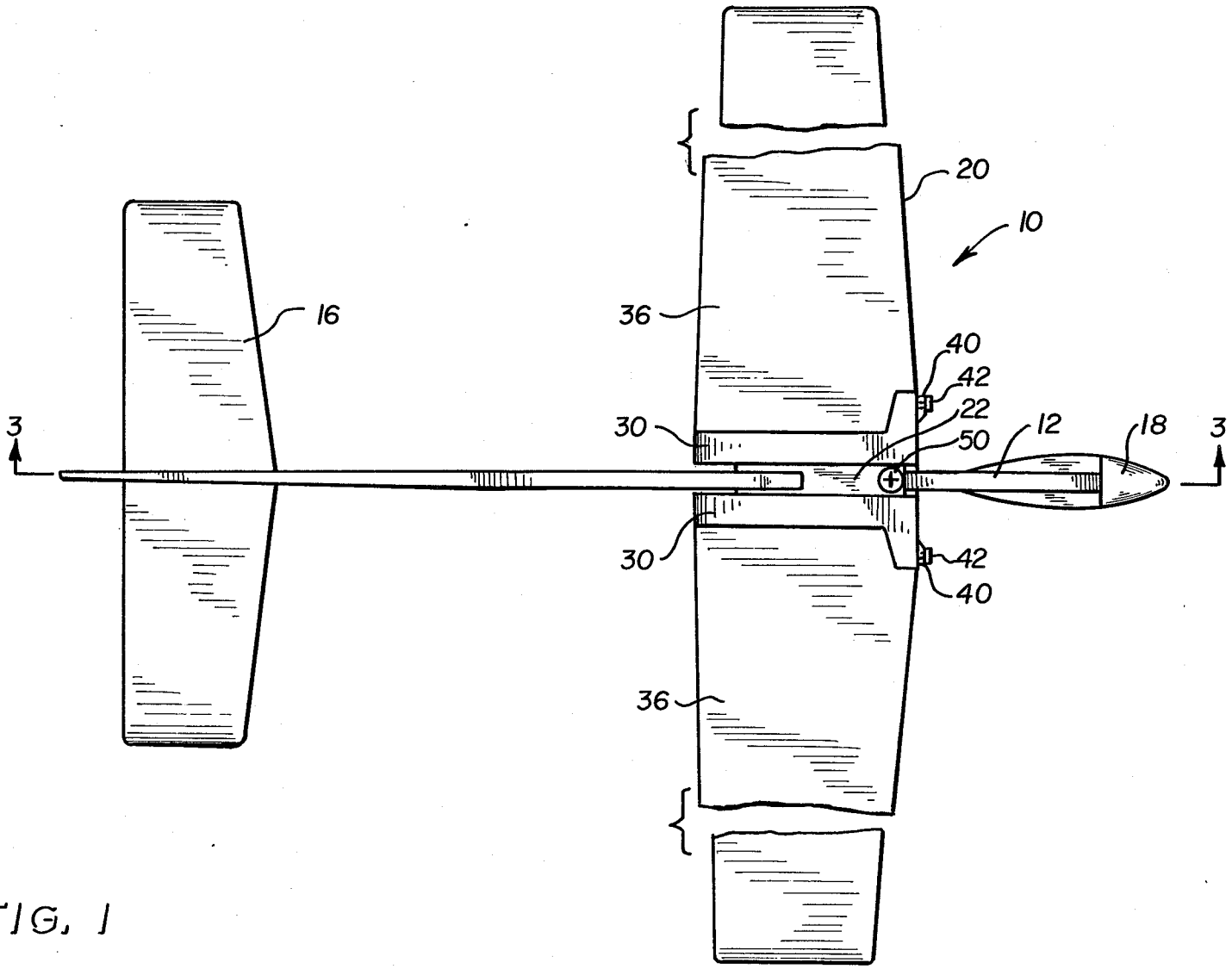
FIG. 1 is a plan view of the glider toy assembly of my invention showing the wings in their flight orientation with respect to the fusilage.

Referring now to the drawings there is shown a glider toy assembly 10 embodying the present invention, and including an aerodynamically shaped elongated fusilage 12 constructed of any suitable material such as plastic or wood. Integral with fusilage 12 is a vertical stabilizer 14 also of an aerodynamic shape. A horizontal stabilizer 16 is removably received in a slot provided in the fusilage 12 and disposed adjacent the lower edge of the vertical stabilizer 14. The horizontal stabilizer 16 may be formed of any suitable material such as styrofoam. The fusilage 12 is provided with a generally conically shaped nose section 18 formed of a rubber or rubber-like material.

A wing assembly 20 is pivotably secured to the fusilage 12, and includes an elongated main wing support housing 22 having a yoke-like construction to surround an upper section of the fusilage. The main wing support housing 22 is pivotably connected to a pair of oppositely disposed buttons 24 integrally formed on the body of the fusilage 12. The main wing support housing 22 is thus pivotable about an axis transverse to the longitudinal axis of the fusilage 12 toward and away from the vertical stabilizer 14. When the wing support housing 22 is pivoted away from the vertical stabilizer 14 it will substantially align with the fusilage 14 and will abut an upper portion of the fusilage. Connected with each side of the main wing support housing 22 are identically formed elongated wing receiving members 30 which have a pocket-like shape. Each wing receiving member 30 has its inner edge pivotably connected to the side edge of both sides of the main wing support housing 22. Thus, the wing receiving members 30 pivot or rotate about axes generally parallel the longitudinal axis of the main wing support housing 22. A pair of identical elongated aerodynamically shaped wings 36 are provided, one each being snugly received at its inner end portion thereof into one pocket-shaped wing receiving member 30. Each wing 36 is formed of a suitable material such as styrofoam.

The construction of the main wing support housing 22 and wing receiving members 30 permits the wings 36 to be pivoted or rotated upwardly and rearwardly of the fusilage 12 as illustrated in phantom outline in FIG. 2 of the drawings. A resilient force imparting member such as elastic band 40 is operative between the fusilage 12 and the wing receiving members 30 for imparting a force to hold the wings 36 in flight orientation with respect to the fusilage. The elastic band 40 has each of its opposite ends looped around knobs 42 integrally formed on forward portions of the wing receiving members 30. The elastic band 40 is reeved about a pocket member 44 formed on the underside of the fusilage 12. Thus, whenever a force on the wings 30 rotating the wings out of flight orientation is removed, the force imparted by the elastic band 40 will urge the wings into their flight orientation.

A sling-shot like catapult 50 having a typically yoke shaped, handheld body 52 securing an elastic band 54 is provided for use in launching the glider toy 10. The free end of the elastic band 54 is secured to a hook shaped slot 56 formed on the underside of the fusilage 12. To launch the glider toy 10, the wings 36 are pivoted rearwardly to longitudinally align with the fusilage 12 and are held against the vertical stabilizer 14. The glider toy 10 is pointed vertically upwardly for launching to a maximum height and the elastic band 54 of the catapult 50 is urged to its maximum length under tension and the glider toy is then released. When the glider toy 10 reaches its maximum height the wings 36, under the urging of elastic band 40, will be restored to their flight orientation and the glider toy 10 will fly smoothly to earth.

To provide varying looping flight patterns, the angles of attack of the wings 36 may be selectively changed. An adjusting screw 50 may be received in an opening provided through the upper section of the main wing support housing 22. The lower end of the adjusting screw 50 will abut an upper portion of the fusilage 12, and turning the screw either clockwise or counterclockwise will change the angle the longitudinal axis of the wing support housing 22 makes with the longitudinal axis of the fusilage 12, and thus change the angle of attack of the wings 36.

It should now be apparent how the glider toy 10 of my present invention provides the advantages stated in the introductory part of this specification. It should also be recognized that my glider toy 10 is simply constructed and may be inexpensively manufactured and sold at a retail price affordable to the buying public. The pivotable feature of my wing assembly 20 and removable horizontal stabilizer 16 also allows for compact and attractive packaging of the entire assembly.

While I have shown and described a present preferred embodiment of this invention, it is to be distinctly understood that the invention is not limited thereto, but may be otherwise embodied within the scope of the following claims.

I claim:

1. A toy glider assembly, comprising:

an elongated aerodynamically shaped fusilage having a first longitudinal axis, a nose section, sides, lower and upper portions, and a rear vertical stabilizer having upper and lower portions;

a horizontal stabilizer in said fusilage adjacent the lower portion of said vertical stabilizer;

an elongated main wing support housing having a second longitudinal axis and sides pivotably connected to such fusilage at an intermediate point to rotate about an axis transverse to the first longitudinal axis of said fusilage toward and away from said vertical stabilizer such that when said wing support housing is pivoted away from said vertical stabilizer it will substantially align with said fusilage and will abut an upper portion of said fusilage;

a pair of oppositely disposed elongated wing receiving members having inner and outer sides, and front and rear sections, each having their inner side pivotably connected along the side of said main wing support housing to rotate about an axis generally parallel to said second longitudinal axis of said main wing support housing;

a pair of complementary shaped elongated aerodynamically formed wings, each received at its inner end section by a said wing receiving member;

said fusilage, main wing support housing, wing receiving members, and wings being constructed and arranged with respect to each other such that when said main wing support housing is rotated toward said vertical stabilizer, and said wing receiving members are pivoted toward said main wing support housing, said wings will align longitudinally with and will abut the sides of said fusilage;

a resilient force imparting means operative between a lower portion of said fusilage and the front sections of said wing receiving members to urge a pivoting force thereon to pivot said wing receiving members with respect to said main wing support housing and said main wing support housing with respect to said fusilage to emplace said wings in their flight orientation with respect to said fusilage whenever any externally applied force on said wings tending to pivot said wings into longitudinal alignment with said fusilage is removed; and an adjusting screw arranged between said main wing support housing and an upper portion of said fusilage for selectively adjusting the angle of attach of said wings by rotating said screw.

2. A toy glider assembly as set forth in claim 1 including catapult means operative with said fusilage for imparting a launching force to the entire toy glider assembly.

3. A toy glider assembly as set forth in claim 1 wherein said horizontal stabilizer is removably supported by said fusilage.

* * * * *